US007395641B2

(12) United States Patent
Sikora et al.

(10) Patent No.: US 7,395,641 B2
(45) Date of Patent: Jul. 8, 2008

(54) METHOD OF DETECTING AND REJECTING FAULTY CIGARETTES

(75) Inventors: Leszek Sikora, Radom (PL); Krzysztof Stolarski, Radom (PL)

(73) Assignee: International Tobacco Machinery Poland Ltd., Radom (PL)

( * ) Notice: Subject to any disclaimer, the term of this patent is extended or adjusted under 35 U.S.C. 154(b) by 0 days.

(21) Appl. No.: 10/550,101

(22) PCT Filed: Mar. 22, 2004

(86) PCT No.: PCT/PL2004/000020

§ 371 (c)(1),
(2), (4) Date: Jul. 5, 2006

(87) PCT Pub. No.: WO2004/085256

PCT Pub. Date: Oct. 7, 2004

(65) Prior Publication Data

US 2006/0260278 A1 Nov. 23, 2006

(30) Foreign Application Priority Data

Mar. 24, 2003 (PL) ..... 359311

(51) Int. Cl.
*B65B 19/30* (2006.01)

(52) U.S. Cl. ..... 53/396; 53/444; 53/54; 53/498; 53/500; 53/151; 131/907; 209/535

(58) Field of Classification Search ..... 53/52–54, 53/498, 500, 444, 148–151, 396; 131/907; 209/535–537

See application file for complete search history.

(56) References Cited

U.S. PATENT DOCUMENTS 3,368,674 A * 2/1968 Koeppe ..... 209/535

(Continued)

FOREIGN PATENT DOCUMENTS

EP 0 086 107 A 8/1983
GB 2228176 A * 8/1990

*Primary Examiner*—Stephen F. Gerrity
(74) *Attorney, Agent, or Firm*—Weterman, Hattori, Daniels & Adrian, LLP.

(57) ABSTRACT

A method relates to a production line where cigarettes are arranged in horizontal layers within approximately vertical channel (3) of packing machine feeding system, the width of which is slightly bigger then the cigarette diameter. The cigarettes are moved gravitationally toward the bottom plate (6) tram which they are transferred to the packing machine, whereas faulty cigarettes are detected with sensors (9, 11) defining their defects, and the faulty cigarettes are rejected by a rejecting device (14). According to the present invention, when the cigarette layer is stopped in the channels, which takes place between consecutive cycles of transferring cigarettes tram the bottom plate to the packing machine, the cigarettes are inspected in all channels of the feeding system with use of movable sensors (9, 11) moving with reciprocating movement along a determined trajectory (7), whereas the movable sensors are coupled with the rejecting device (14) and detection and rejection of faulty cigarettes take place along the same trajectory along which the movable sensors are movable.

19 Claims, 6 Drawing Sheets

Figure 1:
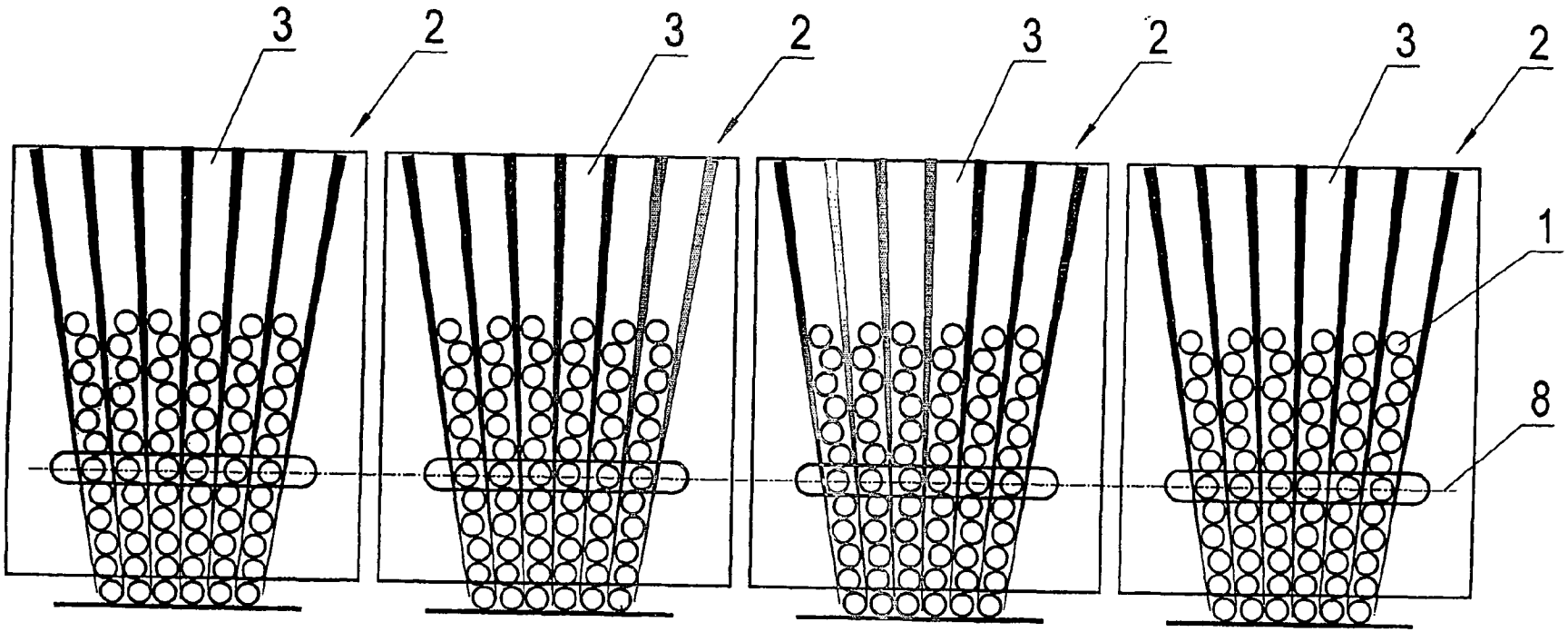

U.S. PATENT DOCUMENTS 4,445,520 A * 5/1984 Knight et al. ..... 131/907
4,648,235 A * 3/1987 Oberdorf ..... 53/54
4,693,374 A * 9/1987 Dall'Osso ..... 209/535
4,742,668 A * 5/1988 Ecabert ..... 53/498
4,962,629 A * 10/1990 Focke ..... 53/498
4,976,544 A * 12/1990 Neri ..... 209/536
6,603,135 B2 * 8/2003 Spatafora ..... 250/559.29

* cited by examiner

METHOD OF DETECTING AND REJECTING FAULTY CIGARETTES

The present invention relates to a method of detecting faulty cigarettes, that is loose end cigarettes or cigarettes with improperly attached filter and rejecting only the faulty cigarettes from production line prior to packing cigarettes into packets.

Defective cigarettes appear as early as while producing them on a cigarette making machine, however the defects may develop also during the transport between machines on a production line. It is the concern of a manufacturer to deliver only good quality cigarettes to the consumer and each manufacturer carries out quality control of all major cigarette parameters, such as loose end and/or filter presence. Most of feeding systems are equipped with approximately vertical channels of the width slightly bigger than the cigarette diameter, along which the cigarettes are gravitationally fed onto a plate, from where they are transfered to a cigarette packing machine. So far, various methods and devices have been used to eliminate defective cigarettes from production. For example, European patent No EP 0.086.107 discloses a device for testing and rejecting cigarettes comprising a set of sliding pushers, which are positioned by spring-type positioning elements. A tip of each pusher is put together with an opened end of a cigarette. Each pusher is covered with reflection surface, which is operated on by an appropriate detector equipped with an optical sensor. Pneumatic rejectors reacting to output signals from optical sensors are located under the pushers, thus a cigarette group inspected within one cycle of the packing machine feeding system operation is placed within operational zone of the rejectors in the next operational cycle. Detection of the cigarette loose end is realized mechanicaly, the pusher being inserted into the cigarette, and the insertion bigger than the optimum value is read by a detector, which sends a signal to an adequate rejector. However this device does not detect improperly attached filters. Next the European patent No. EP 0.853.045 describes a method of testing and rejecting loose end cigarettes within the channels where the cigarettes are gravity fed to a packing machine. On the channel wall being perpendicular to cigarettes axes, at a selected level aligned in front of cigarette opened ends, measuring devices are installed, which send a signal informing about the loose end degree, which activates appropriate rejecting devices fixed to the opposite channel wall. The opened end of each cigarette is tested during free movement against the measuring device within free space developed as a result of blocking the cigarettes above the measuring device, with use of a blocking device, whereas stepwise down movement travel of cigarettes in the column is equal to the cigarette diameter. The constant distance between the measuring device and a cigarette opened end is assured by a pneumatic nozzle acting on the cigarette filter end. The measuring device emits a constant signal, the level of the signal being lower than the threshold value will cause the cigarette rejection at the moment when the defective cigarette while stepwise movement down is set in front of the rejector. The method has been modified as described in European patent No. EP 0.857.651. Cigarette testing method was presented, according to which fixed measuring devices were installed at selected level in front of cigarette opened ends, on the walls of channels feeding cigarettes gravitationally to a packing machine, each measuring device is equipped with two or more control sensors, and cigarettes are stopped successively in front of the measuring devices. Three consecutive phases of processing the signals received from control sensors are used. The first phase comprises receiving information about the position of the tested cigarette with reference to the measuring device. The second phase comprises measurement of the end filling of the cigarette located closest to the measuring device. The third phase comprises optimization of the signals sent from the control sensors to a controller, which in case of monitoring a signal of the value lower than the threshold value activates the rejector at the moment when the defective cigarette moving down gravitationally reaches the position in front of the mentioned device. All known methods of testing and rejecting the defective cigarettes at the inlet of a packing machine are based on a common rule that the cigarettes moving down gravitationally are inspected by fixed measuring devices which are mounted to the channel side walls, generating a signal activating at a certain moment rejection devices, which are also fixed to the said walls, located below the measuring devices.

The present invention constitutes a method of detecting and rejecting faulty cigarettes, according to which the cigarettes are arranged in layers within channels of a packing machine feeding system and move gravitationally towards the bottom plate from which they are transferred to the packing machine, whereas the defective cigarettes are detected with sensors defining their defects and then rejected by rejecting devices. According to the present invention, when the cigarette layer is stopped in the channels, which takes place between consecutive cycles of transfering cigarettes from the bottom plate to the packing machine, the cigarettes are inspected in all channels of the feeding system with use of movable sensors moving with reciprocating movement along a determined trajectory, whereas the movable sensors are coupled with the rejecting device and detection and rejection of defective cigarettes takes place along the same trajectory along which the movable sensors are moved. The distance between the trajectory and the bottom plate may be the same for all the channels and correspond with the same number of cigarettes located in the channels between the plate and the trajectory, or the distance may be not the same for all the channels and correspond with different number of cigarettes located in the channels between the bottom plate and the trajectory. The rejection of a defective cigarette always takes place in the same place, where the defective cigarette has been detected. In case a packing machine is fed from multiple feeding systems, the activities are executed independently for each feeding system, with use of a set of sensors and a rejecting device, which is autonomous for each feeding system. Alternatively in case of multiple feeding systems, the activities can be executed for all feeding systems with use of one common set of sensors and a rejecting device. Detecting a cigarette loose end is executed with use of a sensor located close to a cigarette opened end and detecting improperly attached filter is executed with use of a sensor located close to a cigarette filter end, whereas both sensors are coupled and a cigarette is inspected at both ends simultaneously. The mentioned sensors may constitute photo-optical elements or elements operating within the blacklight, whereas the rejecting device constitutes a pneumatic nozzle. An advantageous solution comprises two pneumatic nozzles located on both sides of the movable sensor, whereas a defective cigarette is rejected always by the pneumatic nozzle following the movable sensor, irrespectively of the direction of the sensor movement. Rejection of a defective cigarette is delayed with respect to the detection moment that is a result of the time needed for replacement of the sensor with the rejecting device. In order to assure the constant distance between the cigarettes and the sensors, two-stage aligning of cigarette ends is executed. The first stage is executed with use of an independent aligning element, and the second one is executed with use of an aligning mechanism, which is coupled with both the sensors and the rejecting device. At least one cycle of detecting and rejecting faulty cigarettes is executed between two consecutive cycles of transfering cigarettes from the bottom plate to the packing machine, whereas each next cycle of detecting and rejecting may be started only after filling the gap generated by the rejected cigarette with a cigarette delivered from the upper layer. Defective cigarettes detection and rejection cycles can be executed continuously, excluding the time of cigarettes dropping in channels by one layer. In order to verify the correctness of the operation of the movable sensors, two reference elements are installed at the level of the sensors operation, one of the elements refers to features of a good quality cigarette and the other one refers to features of a faulty cigarette, whereas during the reciprocating movement the reference elements are inspected by the sensors. In an advantagous solution the reference elements constitute correspondingly a good quality cigarette and a faulty cigarette. The presented method allows prompt detection and practically simultaneous rejection of defective cigarettes from large amount of cigarettes forming a layer across cigarette packing machine feeding systems, whereas the detection of both cigarette loose end and improper filter attachment is realized in one operation.

Figure 2:
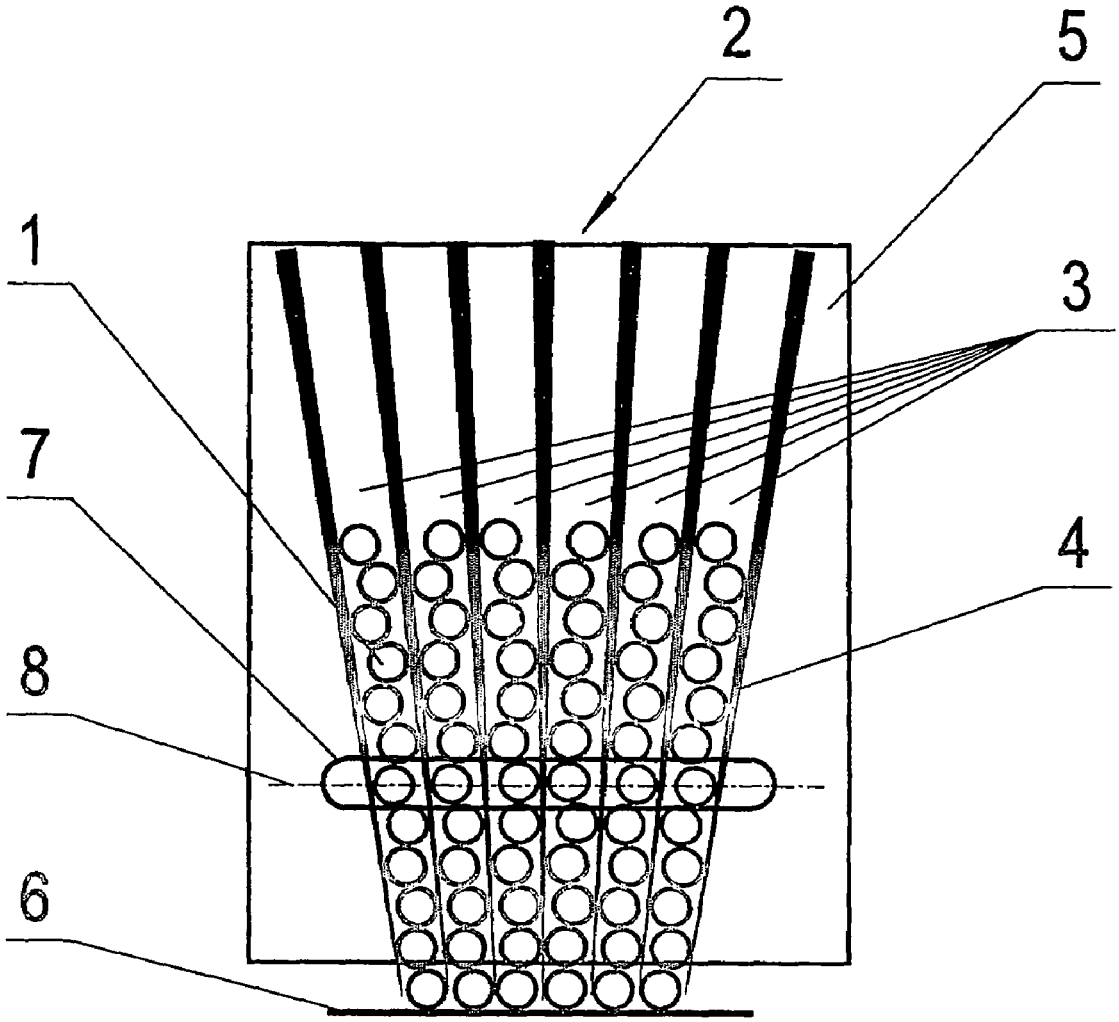
Figure 3:
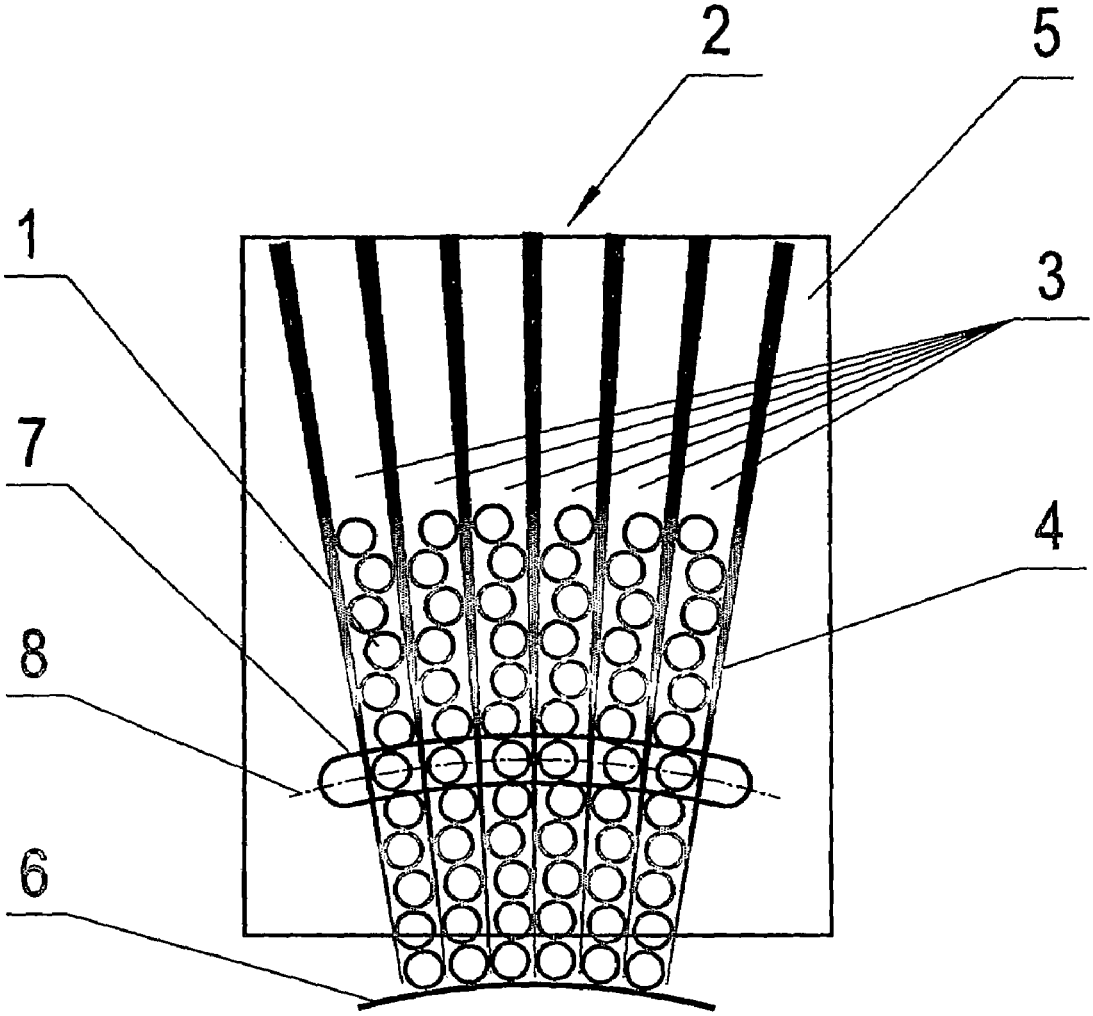
Figure 4:
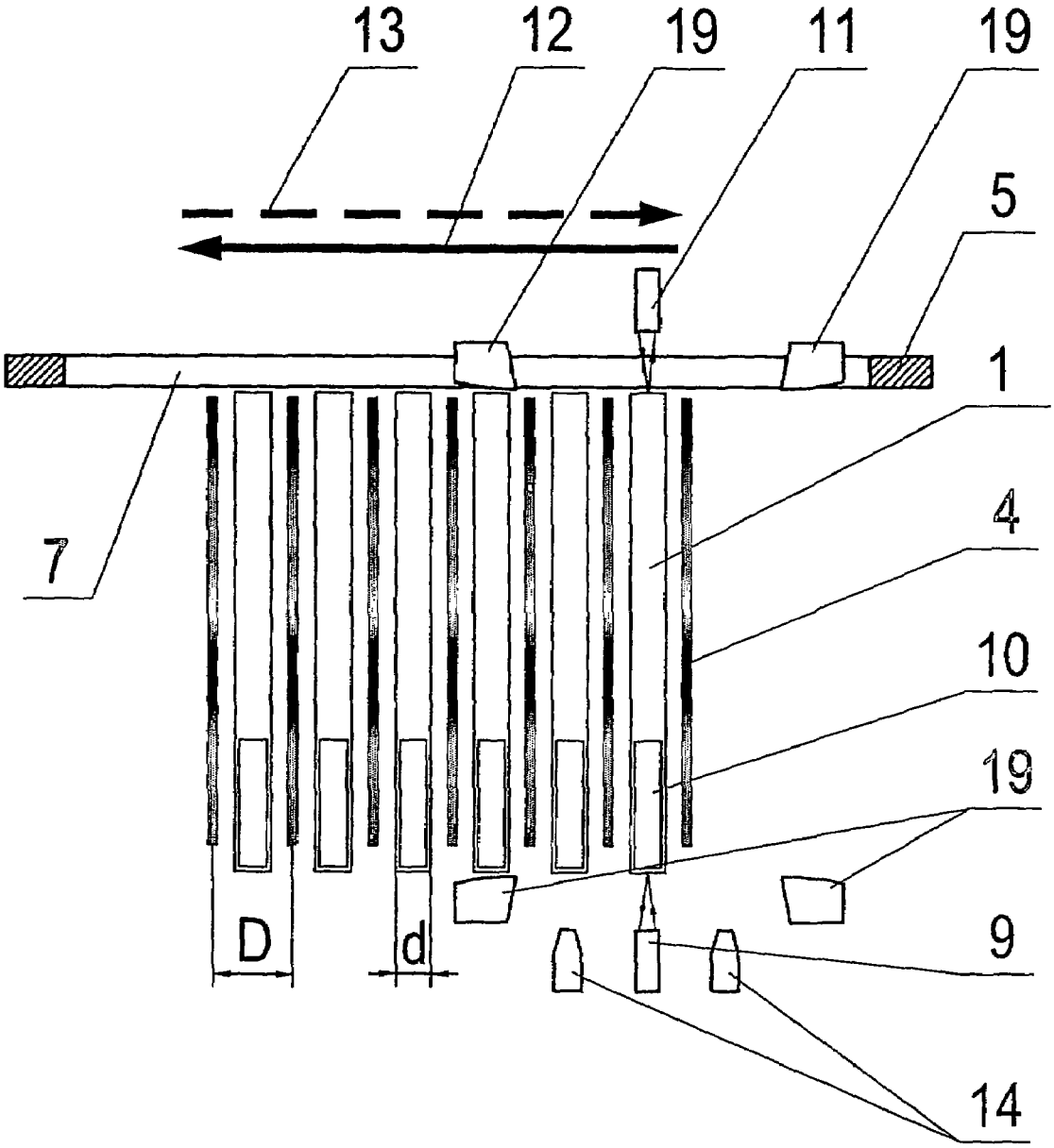
Figure 5:
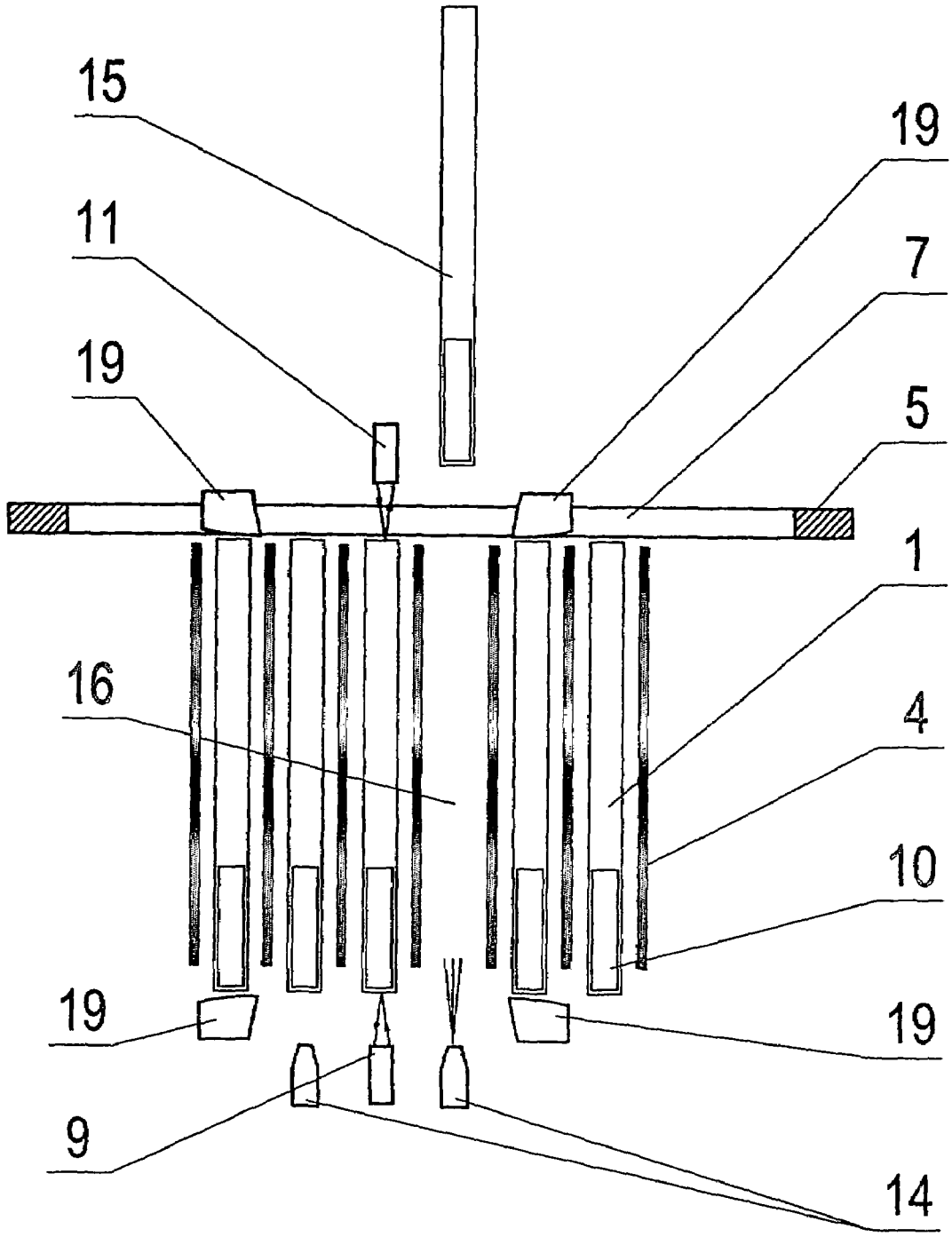
Figure 6:
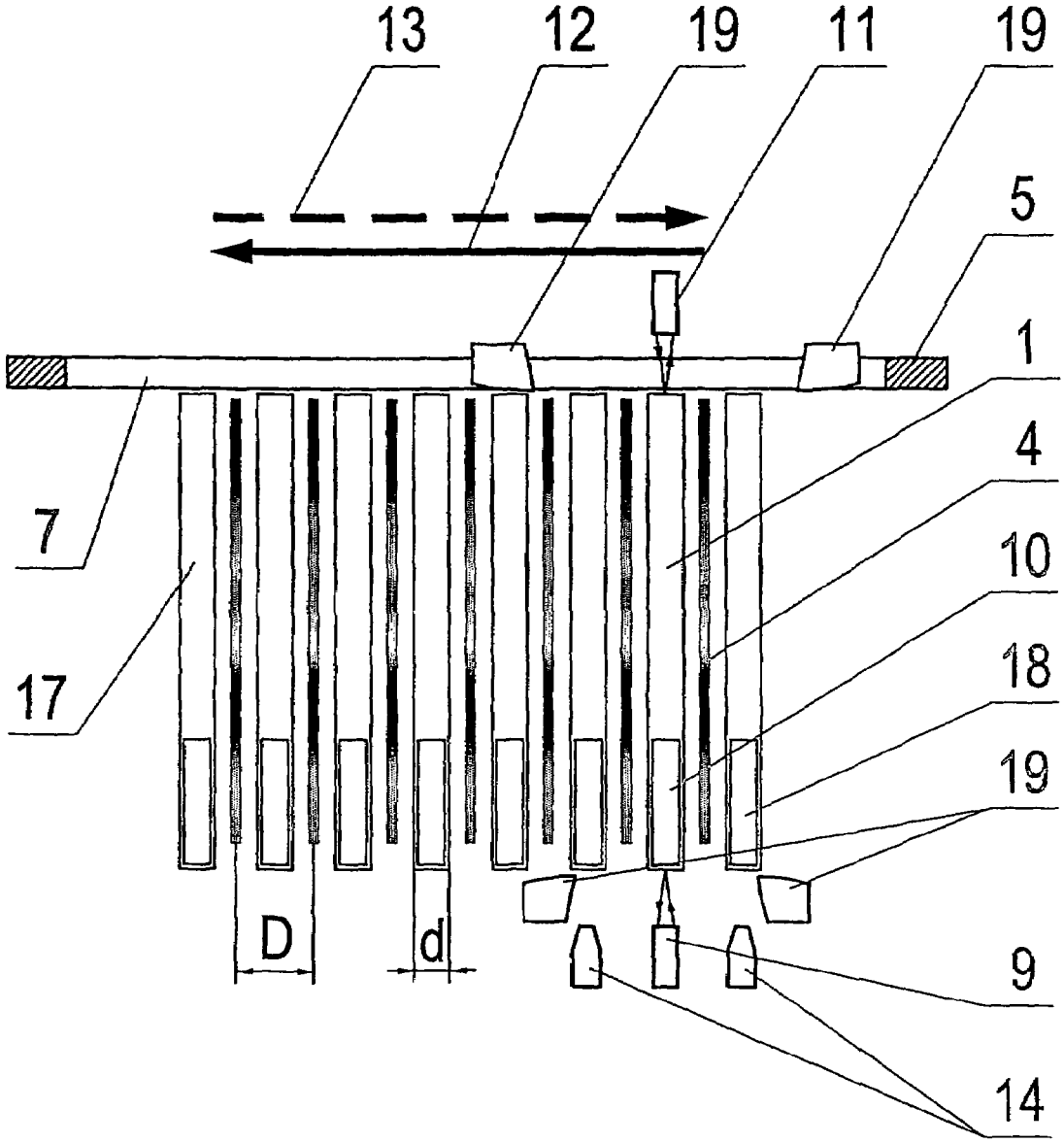

For better understanding, the present invention has been ilustrated in execution examples in figures, where FIG. 1 presents schematically a set of cigarette packing machine feeding systems with channels filled with cigarettes, FIG. 2—one of the feeding systems of FIG. 1 in enlargement, FIG. 3—an alternative example of a feeding system with an arch-curved bottom plate and an adequate sensors movement trajectory, FIG. 4—horizontal projection of the system of FIG. 2 as a section made on a plane at cigarette detection level at the beginning of the detection cycle, FIG. 5—system of FIG. 4 during a detection cycle, after a defective cigarette has been rejected, and FIG. 6—another example of the system shown in FIG. 4 with use of reference elements.

A cigarette packing machine feeding set for feeding cigarettes 1 is composed of four the same feeding systems 2, each having a number of approximately vertical channels 3 of the width D slightly bigger than the diameter d of cigarettes 1 shaped with vanes 4. In each channel 3, the cigarettes 1 supplied from a hopper (not shown) are arranged horizontally in such a position that the opened ends are placed on the side of the wall 5 that is perpendicular to the vanes 4. The cigarettes 1 move down gravitationally within the channels 3 towards the bottom plate 6 located below the wall 5, from which the cigarettes composing a layer are in cycles transfered to the packing machine. In lower part of each wall 5 a longitudinal opening 7 is made, its width is slightly bigger than the diameter d of cigarettes 1 and its length is bigger than total width of all channels 3 of the feeding system 2 measured in the plane of symmetry axis 8 of the hole 7. In the said plane of symmetry axis 8, on the opened side of the channel 3, a sensor 9 detecting improperly attached filters 10 is installed, whereas on the side of the wall 5, a sensor 11 detecting loose ends of cigarettes 1 is installed. Sensors 9 and 11 are coupled and moved along the symmetry axis 8 with reciprocating movement, in direction marked with bolded arrow 12 and in reverse direction marked with dashed arrow 13. The rejecting device 14 is coupled with sensors 9 and 11, the device 14 being composed of two nozzles that are placed on the opened side of the channel 3, in symmetry axis 8 of the hole 7, symmetrically on both sides of the sensor 9 with displacement equal to the distance between adjacent channels 3. Symmetry axis 8 of the hole 7 constitutes a trajectory of the movement of the sensors and the rejecting device, and the trajectory shape corresponds with the shape of the bottom plate 6. The defective cigarette 15 detected with a sensor 9 and/or sensor 11 is rejected by the rejecting device 14 through the hole 7 into the space behind the wall 5. At the same moment sensors 9 and 11 inspect the next cigarette 1 in the next channel 3. The gap generated by the rejected cigarette 15 becomes filled with a next cigarette 1 delivered from the upper layer, whereas this cigarette 1 can be inspected during the return movement of the detectors 9 and 11 together with the rejecting device 14 in the direction marked with dashed arrow 13, or during the returned operational movement executed for the same layer of cigarettes 1 in the direction marked with bolded arrow 12, and the defective cigarette 15 is always rejected by the nozzle following the movable sensor 9, irrespectively of the direction of the reciprocating movement. After the defective cigarettes 15 have been rejected from the inspected layer, the bottom layer of cigarettes 1 placed on the plate 6 becomes displaced to the packing machine, and the level corresponding with the symmetry axis 8 of the hole 7 becomes occupied by next layer of cigarettes 1, whereas the sensors 9 and 11 together with the rejecting device 14 begin the next reciprocating movement, in order to inspect the cigarettes 1 and reject defective cigarettes 15. In the alternative execution example illustrated in FIG. 6, two reference elements 17, 18 placed at the level of the symmetry axis 8 of the opening 7 at both ends of the feeding system 2 were used. The reference element 17 constitutes a good quality cigarette 1, and the reference element 18 constitutes a defective cigarette 15. The reference elements 17, 18 are inspected by sensors 9, 11 during the reciprocating movement cycle, whereas the values of reference signals received from the reference elements 17, 18 by sensors 9, 11 are verified by the control system during each reciprocating movement cycle. Such an alternative execution of the method allows controlling the correctness of the operation of sensors 9 and 11 by the control system. Moreover, in order to assure constant distance between the cigarettes 1 and sensors 9 and 11, two-stage aligning of the ends of cigarettes 1 is executed. The first stage of aligning is executed with use of an independent aligning element (not shown), and the second stage is executed with use of an aligning mechanism 19, which is coupled with sensors 9 and 11 and the rejecting device 14.

The invention claimed is:

1. A method of detecting and rejecting faulty cigarettes, comprising the steps of:

arranging where cigarettes in horizontal layers in channels of a feeding system, gravitationally moving said cigarettes in said feeding system toward a bottom plate, from which said cigarettes are transferred to a packing machine, detecting faulty cigarettes with sensors according to defined defects of faulty cigarettes, and rejecting said faulty cigarettes with a rejecting device, wherein while the cigarettes are in the channels of said feeding system, the cigarettes in all channels of said feeding system are inspected by movable sensors reciprocally moving along a predetermined trajectory, wherein said movable sensors are coupled with the rejecting device, wherein said detection and rejection of faulty cigarettes takes place along said predetermined trajectory in which said movable sensors reciprocally move, and wherein rejection of one of said faulty cigarettes is executed in the same place where the faulty cigarette has been detected.

2. The method as claimed in claim 1, wherein the distance between the predetermined trajectory and the bottom plate is constant for all channels and corresponds with the same number of cigarettes located in the channels between the bottom plate and the trajectory.

3. The method as claimed in claim 1, wherein the distance between the predetermined trajectory and the bottom plate is not constant for all channels and corresponds with different number of cigarettes located in the channels between the bottom plate and the trajectory.

4. The method as claimed in claim 1 wherein multiple feeding systems feed said packing machine, and said fault detection and rejection are executed independently for each feeding system by a set of sensors and a rejecting device autonomous for each feeding system.

5. The method as claimed in claim 1 wherein multiple feeding systems feed said packing machine, and said fault detection and rejection are executed for all feeding systems by one common set of sensors and a rejecting device.

6. The method as claimed in claim 1, wherein cigarette loose end detection is executed by a sensor located near a cigarette opened end, and detection of improperly attached filter is executed by a sensor located near a filter end, and wherein both sensors are coupled and the cigarette is inspected at both ends simultaneously.

7. The method as claimed in claim 1 or 6, wherein the sensors constitute photo-optical elements.

8. The method as claimed in claim 1 or 6, wherein the sensors operate within blacklight.

9. The method as claimed in claim 1 or 6, wherein the rejection of said faulty cigarette is delayed with reference to the moment of detection, which is a result of the time needed to replace the sensor with the rejecting device.

10. The method as claimed in claim 1, wherein the rejecting device constitutes a pneumatic nozzle.

11. The method as claimed in claim 1, wherein the rejecting device comprises two pneumatic nozzles placed symmetrically on both sides of the movable sensor.

12. The method as claimed in claim 11, wherein said faulty cigarette is rejected by one of said pneumatic nozzles which follows the movable sensor.

13. The method as claimed in claim 1, wherein two-phase aligning of cigarette ends is realized in order to assure constant distance between the sensors and cigarettes.

14. The method as claimed in claim 13, wherein the first aligning phase is realized with use of an independent aligning element.

15. The method as claimed in claim 13, wherein the second aligning phase is realized with use of an aligning mechanism coupled with the sensors and the rejecting device.

16. The method as claimed in claim 1, wherein between two consecutive cycles of transferring the bottom layer of cigarettes from the bottom plate to the packing machine, at least one detection and rejection cycle is executed, and wherein each next detection and rejection cycle may be started after filling a gap by the rejection of said faulty cigarette with a new cigarette delivered from the upper layer.

17. The method as claimed in claim 16, wherein the cycles of detection and rejection of faulty cigarettes are executed without breaks, excluding a time when cigarettes drop in channels by one layer.

18. The method as claimed in claim 1, wherein in order to verify correctness of the movable sensors, two reference elements are placed at a level of operation of said movable sensors, one of the reference elements corresponding to features of a good quality cigarette and the other reference element corresponding to features of said faulty cigarette, wherein the reference elements are inspected by the sensors during the reciprocating movement.

19. The method as claimed in claim 18, wherein the reference elements constitute a sample good quality cigarette and a sample faulty cigarette respectively.

* * * * *